US006776093B2

(12) United States Patent
Masuch

(10) Patent No.: US 6,776,093 B2
(45) Date of Patent: Aug. 17, 2004

(54) DRIVE SYSTEM FOR A PRINTING GROUP

(75) Inventor: Bernd Kurt Masuch, Kürnach (DE)

(73) Assignee: Koenig & Bauer Aktiengesellschaft, Würzburg (DE)

( * ) Notice: Subject to any disclaimer, the term of this patent is extended or adjusted under 35 U.S.C. 154(b) by 0 days.

(21) Appl. No.: 10/466,762

(22) PCT Filed: Feb. 5, 2002

(86) PCT No.: PCT/DE02/00416

§ 371 (c)(1),
(2), (4) Date: Jul. 31, 2003

(87) PCT Pub. No.: WO02/076744

PCT Pub. Date: Oct. 3, 2002

(65) Prior Publication Data

US 2004/0089176 A1 May 13, 2004

(30) Foreign Application Priority Data

Mar. 26, 2001 (DE) ..... 101 14 806
Mar. 26, 2001 (DE) ..... 101 14 801

(51) Int. Cl.[7] ..... B41F 3/58; B41F 13/08
(52) U.S. Cl. ..... 101/216; 101/217
(58) Field of Search ..... 101/216, 217, 101/248, 348

(56) References Cited

U.S. PATENT DOCUMENTS 3,732,815 A 5/1973 Greiner et al.
3,742,849 A 7/1973 Greiner et al.
4,198,908 A * 4/1980 Skiera ..... 101/217
5,692,441 A * 12/1997 Michalik ..... 101/232
5,950,538 A 9/1999 Puschnerat
5,979,317 A 11/1999 Singler
6,119,593 A * 9/2000 Pollock ..... 101/349.1
6,267,056 B1 7/2001 Kolbe et al.
6,334,389 B1 1/2002 Fischer
6,408,748 B1 6/2002 Hajek et al.

FOREIGN PATENT DOCUMENTS

| | | |
|---|---|---|
| DE | 2 014 070 | 10/1971 |
| DE | 2 014 753 | 10/1971 |
| DE | 25 53 768 B2 | 6/1981 |
| DE | 40 01 626 A1 | 8/1990 |
| DE | 44 30 693 A1 | 3/1996 |
| DE | 195 16 085 A1 | 11/1996 |
| DE | 196 03 663 A1 | 8/1997 |
| DE | 196 29 605 A1 | 1/1998 |
| DE | 197 24 765 A1 | 12/1998 |
| DE | 197 55 316 C2 | 10/1999 |
| DE | 199 18 399 A1 | 11/1999 |
| EP | 0 644 048 B1 | 7/1999 |
| EP | 1 000 737 A1 | 5/2000 |
| GB | 2 309 668 A | 8/1997 |

* cited by examiner

*Primary Examiner*—Daniel J. Colilla
*Assistant Examiner*—Jill E. Culler
(74) *Attorney, Agent, or Firm*—Jones, Tullar & Cooper PC

(57) ABSTRACT

A drive shaft is provided for a printing group which is comprised of a form cylinder with an inking unit allocated to it, and a second cylinder that cooperates with the form cylinder. The second cylinder forms a printing point with a third cylinder that is not positively connected in a driven manner to the printing group. The form cylinder can be driven by a drive motor. The second cylinder can be driven by a drive connection from the form cylinder. The inking unit allocated to the form cylinder can also be driven by the second cylinder, using the same drive motor.

24 Claims, 4 Drawing Sheets

DRIVE SYSTEM FOR A PRINTING GROUP

FIELD OF THE INVENTION

The present invention is directed to a drive system for a printing group. The printing group includes a forme cylinder, a second cylinder acting with the forme cylinder, and an inking system.

BACKGROUND OF THE INVENTION

A printing group with a forme cylinder and a transfer cylinder driven as a pair is known from DE 44 30 693 A1. The forme cylinder is driven and transfers a driving force to the transfer cylinder via spur gears. In one embodiment, a journal of the forme cylinder, which is embodied as a rotor, can be axially displaced in the stator for adjusting the lateral register.

EP 0 644 048 B1 discloses cylinders driven in pairs. The possibility of coupling an assigned inking system to the drive combination of the pair is disclosed. In a schematic representation, the transfer cylinder is driven by the drive motor. A driving force is transferred from the transfer cylinder to the forme cylinder and from the forme cylinder to the inking system.

In DE 196 03 663 A1 a forme cylinder and a transfer cylinder, acting together with the forme cylinder, can be driven in parallel by a motor. The forme cylinder can be axially adjusted by the use of a gear, and can be displaced in the circumferential direction with respect to the transfer cylinder by the provision of helical gear teeth. An inking system that is assigned to the forme cylinder can be driven by use of a spur gear wheel arranged on the journal of the forme cylinder.

DE 20 14 070 A1 discloses a drive system of a rotary printing press in which cylinder pair of forme and transfer cylinders is driven from the forme cylinder. In order to provide an unequivocal driven connection in the friction drive of two transfer cylinders acting together, the two transfer cylinders are connected non-positively, but releasably, with each other.

The driving of a four-cylinder printing unit by the use of a drive system acting on the respective forme cylinder is known from DE 20 14 753 A1. At least one of the respective transfer cylinders that is driven by its respective forme cylinder can be charged with a braking force in order to prevent tooth flank shifts.

DE 25 53 768 B1 provides a selectively independent driving of a forme cylinder and its associated inking system. The drive combination of the forme cylinder and the transfer cylinder has a releasable coupling. In one possible embodiment, a transfer cylinder and an inking system of a printing group can be driven by a drive motor that is acting on the forme cylinder.

DE 40 01 626 A1 discloses a drive train in which the driving force is transferred in a parallel manner from a counter-pressure cylinder to an inking system and to a transfer cylinder, and from there to a forme cylinder. In this way interferences are re-transferred to a lesser degree from the inking system the forme cylinder.

SUMMARY OF THE INVENTION

The object of the present invention is directed to providing a drive system for a printing group.

In accordance with the present invention, this object is attained by the provision of a printing group having a forme cylinder, a second cylinder acting with the forme cylinder and an inking system assigned to the forme cylinder. A drive system acts on the forme cylinder which drives the second cylinder through a drive connection. The inking system is driven by the second cylinder by a drive connection.

The advantages to be gained by the use of the present invention consist, in particular, in that, because of the drive system being at the forme cylinder, no movement of the drive motor need to occur when the transfer cylinder is placed into the print-on and print-off positions, such as would be the case, for example, in connection with a drive taken directly from the transfer cylinder. Also, a compromise, which would be necessary, based on such pivot movements of the transfer cylinder with regard to the position of the drive motor and the meshing of the gear wheels when the drive motor is arranged on the transfer cylinder, can be omitted when the forme cylinder is driven. Otherwise such pivot moments could lead to gear tooth breaks or to a reduction of the printing quality because of play in the drive system caused by such movements.

The drive system of the printing group in accordance with the present invention is independent of the drive system of a further cylinder or of a further printing group which, together with the printing group, constitutes a printing position. The drive system preferably does not have any mechanical, and in particular does not have any positive drive connection with the latter.

If only the inking system and the transfer cylinder are configured for making and releasing contact, a rigid connection of the drive motor with a frame can be provided.

A pinion gear of the drive motor, which is provided with straight teeth, can transfer power directly to a straight-toothed pinion gear wheel located at the journal of the forme cylinder, provided that the straight-toothed gear embodiment assures the required strength values, for example extent of coverage and breaking resistance.

In another embodiment of the present invention, the drive motor can be positioned directly axially aligned in relation to the forme cylinder. To make possible an axial movement of the forme cylinder, which is necessary for the purpose of adjusting the lateral register, a coupling, which is flexible or shiftable in the axial direction, can be arranged between the forme cylinder journal and the drive motor. The embodiment of the present invention with the drive motor having a planetary gear arranged between the rotor of the drive motor and the journal of the cylinder is advantageous in respect to providing desirable ranges of the numbers of revolutions, in particular in the start-up phase of the printing group.

In those cases where strength requires helical gear teeth for force transfer, a drive arrangement is advantageous in which the pinion gear of the drive motor does not transfer power directly to the spur gear wheel of the forme cylinder. In such a case, a displacement of the circumferential register would take place simultaneously with an axial movement of the forme cylinder, unless additional measures have been taken. These measures would be, for example, a simultaneous correction through the provision of a control device. Such a correction requires an outlay for such regulation, or requires a permissible relative movement of the journal with respect to the spur wheel of the forme cylinder which relative movement, however, requires guide devices that cannot, or only with a large outlay, be produced free of play in the circumferential direction. A coupling, which is flexible in the axial direction, could again be employed, in an advantageous manner, for the axial mobility of the forme cylinder.

It is advantageous, in connection with the above-discussed preferred embodiments of the drive system of the forme cylinder in accordance with the present invention, if an inking system that is assigned to the forme cylinder and, if provided, a dampening system, are also driven by the same drive motor. This saves expense and assures synchronization, provided that the correct transmission ratios are employed.

An unequivocal and certain flow or transfer of moment or drive torque from the drive motor to the various units to be driven is particularly advantageous for the exact roll-off of the cylinders and rollers during production. In an advantageous embodiment, this is achieved because driving takes place from the forme cylinder to the transfer cylinder, and from the transfer cylinder to the inking system serially. In this connection, an embodiment is particularly economical in which driving takes place from the transfer cylinder to the inking system through a gear wheel, which gear wheel is rotatably seated on the journal of the forme cylinder.

A coupling between the drive motor and the forme cylinder, which coupling is flexible in the axial direction is embodied, in an advantageous manner, as a shaft coupling, which is flexible, or yielding, in the axial direction. Such a shaft coupling can be, for example an expansion coupling or a compensation coupling. The employment of a non-shiftable, positive shaft coupling which, in contrast to other positive couplings, is almost free of play in the circumferential direction, without requiring a large production outlay, and which simultaneously allows an axial length change of the coupling, such as an axial movement of the forme cylinder, is particularly advantageous. The coupling is embodied to be positive in the axial direction, but is flexible or yielding in length, for example by the provision of an elastic and reversible deformation.

The steps for an unequivocal and certain moment or torque flow direction and, if a coupling is required, for the embodiment of the latter as a torsion-proof, but longitudinally adjustable coupling, are used for minimizing the play in the drive system, and for an improvement of the print quality because of this.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
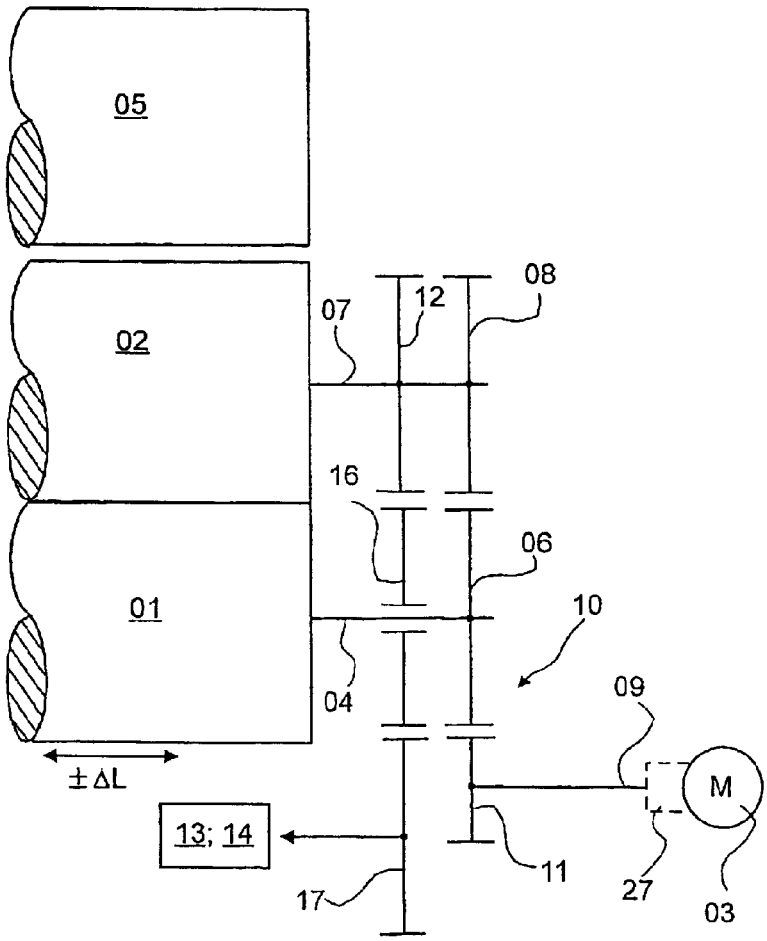
FIG. 1, a first preferred embodiment of a drive system of a printing group in accordance with the present invention, in FIG. 2, a second preferred embodiment of the drive system of a printing group, in FIG. 3, a third preferred embodiment of the drive system of a printing group, and in FIG. 4, a fourth preferred embodiment of the drive system of a printing group.

Referring initially to FIG. 1, there may be seen a first preferred embodiment of a drive system for a printing group in accordance with the present invention. A printing group of a printing press has a first cylinder 01, for example a forme cylinder 01, and a second cylinder 02, for example a transfer cylinder 02. The two cylinders 01, 02 can be driven together by the use of a drive motor 03, which is in operative connection with the forme cylinder 01, and where power is transferred from the forme cylinder 01 to the transfer cylinder 02 by a drive connector. During printing, the transfer cylinder 02 acts together with, and forms a printing position with a third cylinder 05, which is only shown in FIG. 1, and which may be, for example, a second transfer cylinder 05 of a cooperating printing group, or a counter-pressure cylinder 05, for example a satellite cylinder 05, which does not convey ink. The drive system of the third cylinder 05, or of the cooperating second printing group, is not in a positive drive connection with the printing group driven by the drive motor 03.

As represented in FIG. 1, a forme cylinder gear wheel 06, which is arranged, fixed against relative rotation, on a journal 04 of the forme cylinder 01, together with a transfer cylinder gear wheel 08, which is arranged, fixed against relative rotation, on a journal 07 of the transfer cylinder 02, constitutes the drive connection between the forme cylinder 01 and the transfer cylinder 02.

In a first preferred embodiment of the present invention, as shown in FIG. 1, a pinion gear 11, that is arranged on a shaft 09 of the drive motor 03, acts directly on the forme cylinder gear wheel 06 which is arranged on the journal 04 of the forme cylinder 01. The gear arrangement 11, 06 from the drive motor 03 to the forme cylinder journal 04, or to the gear wheel 06, can also be constituted by the use of a differently embodied gear, or for example by way of further gear wheels, toothed belts, bevel wheels, or in any other way. However, to assure an axial displaceability, which is indicated schematically by a two-headed arrow in FIG. 1, of the forme cylinder 01, the motor pinion gear 11, as well as the gear wheels 06, 08 are embodied in the preferred embodiment with straight teeth. The width of the motor pinion gear 11 and of the gear wheels 06, 08 has been selected to be such that, in case of an axial displacement of the forme cylinder 01 by an amount$\pm\Delta$ L, a sufficient coverage of the teeth is assured.

A second transfer cylinder gear wheel 12 is arranged, fixed against relative rotation, on the journal 07 of the transfer cylinder 02, and from which an inking system 13 assigned to the forme cylinder 01 and, if provided, a dampening unit 14, are driven. The inking system 13 and the dampening unit 14 are only schematically represented as reference numerals in the drawing figures.

In the first preferred embodiment, the second transfer cylinder gear wheel 12 drives an intermediate gearwheel 16, which is rotatably arranged on the journal 04 of the forme cylinder 01, and which intermediate gear wheel 16 in turn meshes with inking system drive gear wheel 17 of a drive system, which is not further represented, of the inking system 13 and, if provided, of the dampening unit 14.

The moment or torque flow of the drive system from the drive motor 03 via the forme cylinder 01 to the transfer cylinder 02, and from there to the inking system 13 and, if provided, to the dampening unit 14 takes place unequivocally and positively, because it is serial. A shift of the tooth flanks during load changes and thereby the bringing the cylinders 01, 02, the inking system 13, the dampening unit 14 in or out of contact, or changes in the conditions is avoided to a large extent, which results in reduced wear and, in particular, in better printing results.

Figure 2:
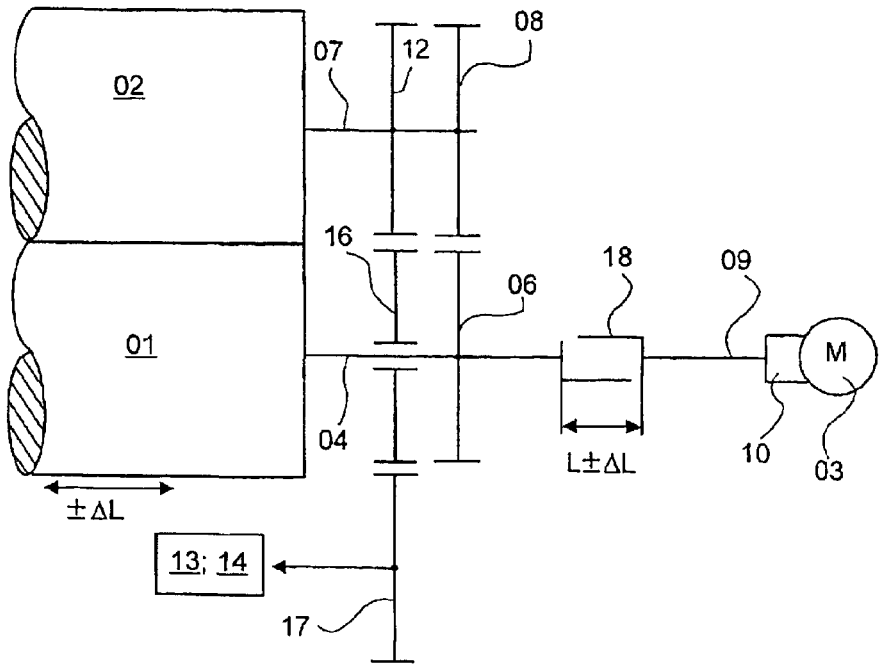

In a second preferred embodiment of the present invention, as shown in FIG. 2, the shaft 09 of the drive motor 03 is arranged coaxially with respect to an axis of rotation of the forme cylinder 01 and is connected, in a torsion-proof manner, with the journal 04 of the forme cylinder 01. In a preferred configuration, a coupling, which can be changed in its length L in the axial direction by the amount±Δ L, for example a coupling 18, is arranged between the drive motor 03 and the journal 04. In particular, the coupling 18 can be an expansion coupling 18, a coupling 18 which is elastic in the axial direction, or a non-shiftable shaft coupling 18 which is, positively connected in the axial direction, but is resilient. In this configuration, the end of the coupling 18 facing away from the forme cylinder 01 is arranged fixed in place in respect to an axial direction. With the arrangement of the coupling 18, the associated drive motor 03 can therefore be fixed in place, or secured to the frame, in case of an axial displacement of the forme cylinder 01. The amount Δ L of an axial displacement of the forme cylinder 01 preferably lies between 0 and ±4 mm, and in particular lies between 0 and ±2.5 mm, and is picked up by the change of the length L of the coupling 18 by this amount±Δ L.

A particularly suitable coupling 18 is a flexibly resilient all-metal coupling, also referred to as a diaphragm coupling or a ring coupling.

Figure 3:
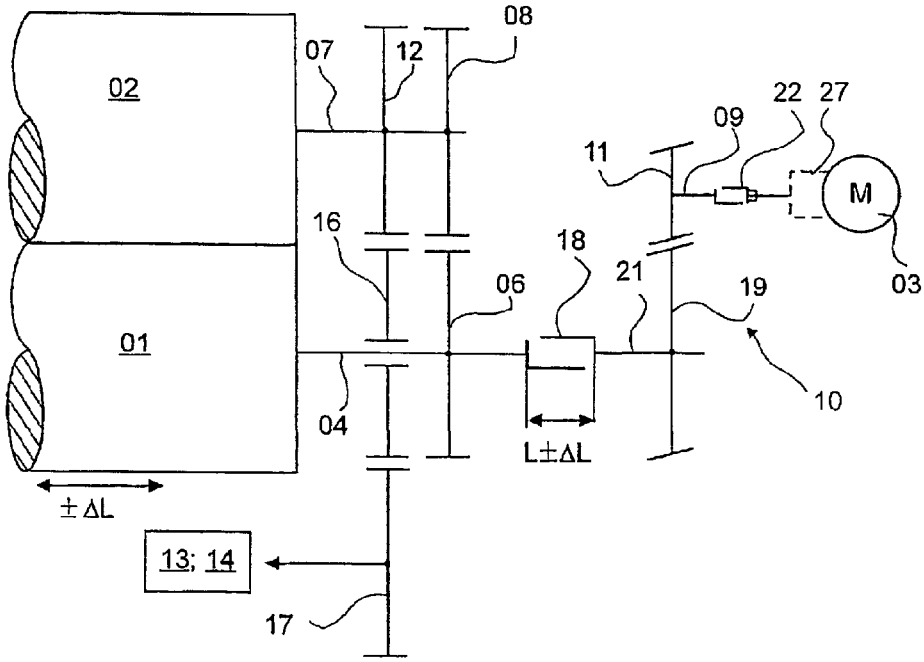

A third preferred embodiment of a drive system in accordance with the present invention, as shown in FIG. 3, differs from the second preferred embodiment of FIG. 2 in that the drive motor 03 is not arranged coaxially in respect to the forme cylinder 01. A motor pinion gear 11 is connected with the shaft 09 of the drive motor 03 and drives a drive gear wheel 19 which is connected, fixed against relative rotation, through a shaft 21 or a journal 21, to the side of the coupling 18 that is facing away from the forme cylinder 01. This third preferred embodiment is particularly advantageous if, because of high loads, the strength values, for example the extent of coverage and breaking resistance, require helical teeth on the motor pinion gear 11 and on the drive gear wheel 19. The two cooperating gear wheels 06, 08 on the journals 04, 07 of the cylinders 01, 02 are embodied, in an advantageous manner, with straight teeth. In this way, a relative axial movement with respect to each other is made possible without a compensation in the circumferential register between the two cylinders 01, 02 being required. The inking system 13, and possibly the dampening unit 14 can be driven from the transfer cylinder 02, in a manner corresponding to the second preferred embodiment.

For improved ease of disassembly, or for maintenance, a further coupling 22, for example a claw coupling 22, or a coupling 22 similar to the coupling 18, can be arranged between the drive motor 03 and the motor pinion gear 11.

Figure 4:
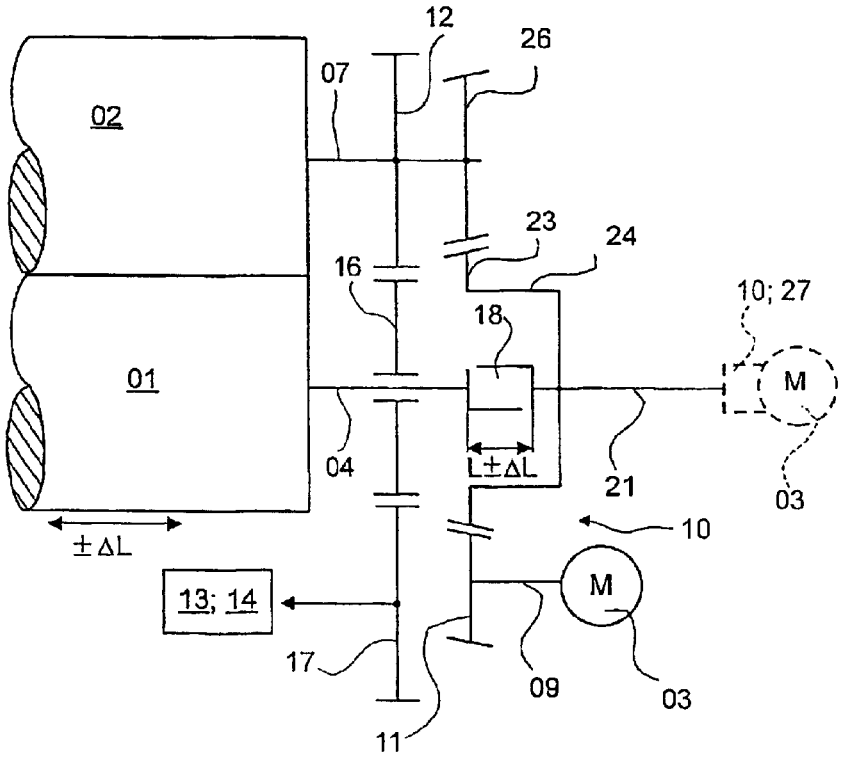

In a fourth preferred embodiment of the present invention, as seen in FIG. 4, the power transfer from the forme cylinder 01 to the transfer cylinder 02 does not occur on the side of the coupling 18 facing the forme cylinder 01, but on the side of the coupling 18 which is not movable in the axial direction. For this purpose, the drive connection between the forme cylinder 01 and the transfer cylinder 02 is not arranged between the coupling 18, whose length L can be changed in the axial direction, and the forme cylinder 01, but on the stationary side of the coupling 18, the side of coupling 18 that is facing away from the forme cylinder 01.

In order to save space and in order to shorten the distance from the drive system of the forme cylinder 01 to the coupling 18, a bushing gear wheel 23 can be arranged, for example, on a bushing 24 which is enclosing the coupling 18 and which can be connected with the side of the coupling 18 facing away from the forme cylinder 01. On one side, this bushing gear wheel 23 meshes with an outer transfer cylinder gear wheel 26 which is connected, fixed against relative rotation, with the journal 07 of the transfer cylinder 02, and with the motor pinion gear 11. In comparison with the embodiment of the invention shown in FIG. 3, a drive level can be saved, and driving of the two cylinders 01, 02 from the drive motor 03 can take place through helical gear teeth. The drive connection formed by the bushing gear wheel 23 and the outer transfer cylinder gear wheel 26 is not located on the side of the coupling 18 facing the forme cylinder 01, which is the side of the coupling 18 to be moved axially, but is on the side of the coupling 18 which is fixed in place with respect to an axial movement. In this case, it is advantageous if the distances of the gear wheels 23, 26 from the respective cylinders 01, 02 are as short as possible. As depicted in FIG. 4, driving of the cylinders 01, 02 can also take place coaxially directly to the shaft 21, but in particular via a gear, for example a reduction gear.

For all of the described preferred embodiments, and in particular for the preferred embodiments of FIGS. 2 and 4 with the drive motor 03 arranged coaxially with the forme cylinder 01, a reduction gear 10, 27, for example a planetary gear 10, 27, of which only a portion is shown, can be arranged on the drive motor 03, or between the drive motor 03 and the drive connection between the forme cylinder 01 and the transfer cylinder 02 in an advantageous further development. This reduction gear can be, for example, an adapter gear, which is connected with the drive motor 03 and which reduces the number of revolutions of the drive motor.

The drive connections between the two cylinders 01, 02 and/or one of the cylinders 01, 02 and the inking system 13, and possibly also the dampening unit 14, can also be provided through toothed belts, possibly by taking the reversal of the direction of rotation into account, or by other positively connected drive connections.

The operation of the drive system for a printing group, in accordance with the present invention, is as follows:

In the course of the operation, i.e. in the course of the set-up or production operation, the forme cylinder 01 is driven by the drive motor 03, and the transfer cylinder 02 is driven by the forme cylinder 01. At the same time, the inking system 13, and possibly also the dampening unit 14, are driven indirectly by this drive motor 03. In the course of accomplishing a pivoting of the transfer cylinder 02 out or in, the drive motor 03, driving the forme cylinder 01, can remain stationary and in a position for an ideal contact with the possibly cooperating motor pinion[s] gear 11 and forme cylinder gear wheel 06.

If a correction of the lateral register, i.e. a lateral displacement of the printed image, is required, the forme cylinder 01 will be displaced in the axial direction by an amount of ±Δ L, for example by the use of an axial shifting drive arrangement, which is not specifically represented, and which is preferably arranged on the side of the forme cylinder 01 opposite the cylinder drive system, without the drive motor 03 also needing to be displaced.

In one embodiment, the amount ±Δ L of the displacement of the forme cylinder 01 is absorbed by the coupling 18, wherein the end of coupling 18 that is facing away from the forme cylinder 01 is fixed in place, and in particular is fixed in place in respect to the axial direction. The axial displacement does not cause a simultaneous displacement of the circumferential register.

In another embodiment with a drive motor 03 which is not coaxially arranged with respect to the forme cylinder 01, an axial displacement of the forme cylinder 01 without a coincidental displacement of the circumferential register is possible by the use of straight teeth between the gear wheel 06 and the pinion 11.

A correction, by the use of an electronic shaft between the cylinders 01, 02, as well as a mechanical readjustment of the circumferential register, because of a displacement in the lateral register, can be omitted.

While preferred embodiments of a drive system for a printing group in accordance with the present invention have been set forth fully and completely hereinabove, it will be apparent to one of skill in the art that various changes in, for example the specific type of printing machine including the printing group, the sizes of the cylinders, and the like could be made without departing from the true spirit and scope of the present invention which is accordingly to be limited only by the following claims.

What is claimed is:

1. A drive system for a printing group comprising:

a forme cylinder;

a second cylinder cooperating with said forme cylinder;

an inking system assigned to said forme cylinder;

a drive system for said forme cylinder and said second cylinder, said drive system acting on said forme cylinder, said forme cylinder driving said second cylinder through a first drive connection; and a second drive connection driving said inking system from said second cylinder.

2. The drive system of claim 1 further including a third cylinder cooperating with said second cylinder to form a print position, said third cylinder being out of mechanical drive connection with said second cylinder.

3. The drive system of claim 1 further including a drive motor for said forme cylinder, said drive motor driving said forme cylinder mechanically independently of another printing group.

4. The drive system of claim 3 wherein said inking system assigned to said forme cylinder is driven by said drive motor.

5. The drive system of claim 1 wherein said first drive connection between said forme cylinder and said second cylinder is a gear train.

6. The drive system of claim 5 wherein said gear train includes a second cylinder gear wheel connected, fixed against rotation, with said second cylinder, and a forme cylinder gear wheel connected in a torsion-proof manner with said forme cylinder and acting with said second cylinder gear wheel.

7. The drive system of claim 1 further including a toothed belt between said forme cylinder and said second cylinder, said toothed belt forming said first drive connection.

8. The drive system of claim 1 wherein said second drive connection between said forme cylinder and said inking system is a gear train.

9. The drive system of claim 8 wherein said second drive connection includes a second cylinder gear wheel connected, fixed against relative rotation, to said second cylinder, an intermediate gear wheel rotatably supported by said forme cylinder and acting with said second cylinder gear wheel, and an inking system gear wheel acting with said intermediate gear wheel.

10. The drive system of claim 1 wherein said second drive connection between said second cylinder and said inking system includes a toothed belt.

11. The drive system of claim 1 further including a drive motor driving said forme cylinder, and a torsion-proof coupling having a length that is variable in an axial direction of said forme cylinder, said coupling being arranged between said drive motor and said forme cylinder.

12. The drive system of claim 11 wherein said coupling is a shaft coupling which is torsion proof in a circumferential direction, which is positively connected in said axial direction, and is resilient.

13. The drive system of claim 11 further including a drive motor shaft connected to said coupling on a side of said coupling facing away from said forme cylinder.

14. The drive system of claim 11 further including a shaft arranged on said coupling fixed against relative rotation with respect to said coupling and extending coaxially with, and parallel to an axis of rotation of said forme cylinder, said shaft being arranged on said coupling on a side of said coupling facing away from said forme cylinder.

15. The drive system of claim 14 further including a shaft gear wheel on said shaft and a drive motor pinion gear, said shaft gear wheel meshing with said drive motor pinion gear.

16. The drive system of claim 15 wherein said shaft gear wheel and said pinion gear wheel have helical gear teeth.

17. The drive system of claim 1 further including a forme cylinder drive motor and a gear driving said forme cylinder from said forme cylinder drive motor.

18. The drive system of claim 1 further including a forme cylinder drive motor having a shaft, said shaft being parallel with, and offset with respect to an axis of rotation of said forme cylinder.

19. The drive system of claim 1 further including a forme cylinder drive motor having a shaft, said shaft being parallel with, and coaxial with an axis of rotation of said forme cylinder.

20. The drive system of claim 19 further including a torsion-proof coupling arranged between said forme cylinder and said forme cylinder drive motor, said shaft connected to said coupling on a side of said coupling facing away from said forme cylinder.

21. The drive system of claim 1 further including a drive motor driving said forme cylinder and a planetary gear arranged between said forme cylinder drive motor said forme cylinder.

22. The drive system of claim 1 further including a drive motor driving said forme cylinder and a gear-reducing adapter gear arranged between said forme cylinder drive motor and said forme cylinder.

23. The drive system of claim 1 wherein said second cylinder is a transfer cylinder.

24. The drive system of claim 1 wherein said second cylinder is a counter-pressure cylinder.

* * * * *